US011505763B2

(12) United States Patent
Marques de Lima

(10) Patent No.: US 11,505,763 B2
(45) Date of Patent: Nov. 22, 2022

(54) ENZYMATIC DEGUMMING OF UNREFINED TRIGLYCERIDE OIL

(71) Applicant: Purac Biochem B.V., Gorinchem (NL)

(72) Inventor: Danilo Marques de Lima, São Paulo (BR)

(73) Assignee: Purac Biochem B.V., Gorinchem (NL)

( * ) Notice: Subject to any disclaimer, the term of this patent is extended or adjusted under 35 U.S.C. 154(b) by 249 days.

(21) Appl. No.: 16/895,763

(22) Filed: Jun. 8, 2020

(65) Prior Publication Data

US 2020/0299610 A1 Sep. 24, 2020

Related U.S. Application Data

(63) Continuation of application No. PCT/NL2017/050864, filed on Dec. 21, 2017.

(51) Int. Cl.
*C11B 3/00* (2006.01)
*C11B 3/16* (2006.01)

(52) U.S. Cl.
CPC ..... *C11B 3/003* (2013.01); *C11B 3/006* (2013.01); *C11B 3/16* (2013.01)

(58) Field of Classification Search
CPC . C11B 3/003; C11B 3/006; C11B 3/16; C11B 3/04; C11B 3/06; C11B 3/001
See application file for complete search history.

(56) References Cited

U.S. PATENT DOCUMENTS 5,532,163 A * 7/1996 Yagi ..... C11B 3/003 435/267
8,956,853 B2 2/2015 Dayton et al.
2004/0005399 A1 1/2004 Chakrabarti et al.
2008/0182322 A1 7/2008 Dayton et al.
2014/0371476 A1 12/2014 Dayton et al.

FOREIGN PATENT DOCUMENTS

EP 2 053 118 A 4/2009

OTHER PUBLICATIONS

Dijkstra Albert J: "Enzymatic degumming", European Journal of Lipid Science and Technology, Wiley VCH Verlag, Weinheim,DE,vol. 112, No. 11, Nov. 1, 2010 (Nov. 1, 2010), pp. 1178-1189, XP002618404,ISSN: 1438-7697, DOI:10.1002/EJLT.201000320, p. 1181, col. 1. paragraph 3, tables 1,3.
International Search Report dated Aug. 21, 2018 in corresponding International Application No. PCT/NL2017/050864, 4 pages.
Sarode Manjula et al: "Degumming rice bran oil using phospholipase-AI", European Journal of Lipid Science and Technology.,vol. 113, No. 5, May 1, 2011 (May 1, 2011), pp. 658-664, XP055498274, DE, ISSN: 1438-7697, DOI:10.1002/ejlt.201000376.

* cited by examiner

*Primary Examiner* — Deborah D Carr
(74) *Attorney, Agent, or Firm* — Foley & Lardner LLP

(57) ABSTRACT

The invention relates to a process for enzymatic degumming of unrefined triglyceride oil, said process comprising the following successive steps: (a) providing an unrefined triglyceride oil having a phosphorus content of at least 100 mg per kg of unrefined triglyceride oil; (b) combining the unrefined triglyceride oil with water, an acid and a phospholipase to produce an oil-in-water emulsion having a pH in the range of 2.5 to 4.5; said phospholipase being selected phospholipase A1, phospholipase A2 and combinations thereof; (c) keeping the emulsion at a temperature of 20-90° C. for at least 10 minutes; (d) introducing a base into the emulsion; and (e) separating degummed triglyceride oil from the emulsion. This enzymatic degumming process is extremely effective in removing phospholipids, including non-hydratable phospholipids (NHP), from unrefined vegetable oils and produces degummed vegetable oil in high yield.

14 Claims, No Drawings

ENZYMATIC DEGUMMING OF UNREFINED TRIGLYCERIDE OIL

CROSS-REFERENCE TO RELATED APPLICATIONS

This application is a continuation of International Application No. PCT/NL2017/050864, filed Dec. 21, 2017, which application is incorporated by reference herein in its entirety.

TECHNICAL FIELD OF THE INVENTION

The invention relates to a process for enzymatic degumming of unrefined triglyceride oil, said process comprising:

providing an unrefined triglyceride oil;

combining the unrefined triglyceride oil with water, an acid and a phospholipase to produce an oil-in-water emulsion having a pH in the range of 2.5 to 4.5; said phospholipase being selected phospholipase A1, phospholipase A2 and combinations thereof;

keeping the emulsion at a temperature of 20-90° C. for at least 10 minutes;

introducing a base into the emulsion; and separating degummed triglyceride oil from the emulsion.

The degumming process of the present invention offers the advantage that it is highly effective in removing phospholipids (gums) from crude and other unrefined triglyceride oils and that it produces degummed triglyceride oil in high yield.

BACKGROUND OF THE INVENTION

Crude vegetable oils, and especially those obtained by solvent extraction, tend to be unpalatable and, therefore, need to be purified before they can be incorporated in food products and/or sold to consumers. The various steps involved in this purification are referred to as "refining".

A distinction is made between chemical and physical refining. Chemical refining comprises the following process steps: 1. degumming, 2. neutralization, 3. bleaching, 4. deodorization. In the degumming step, phospholipids (gums) and metal ions are removed from the crude oil. The neutralization step serves to extract the free fatty acids. In the bleaching step, pigments, further metal ions and residual phospholipids are removed. The final refining step, i.e. deodorization, is a steam distillation, in which volatile compounds that adversely affect the odor and taste of the oil are removed. In physical refining, no neutralization step is employed and free fatty acids are removed in the deodorisation step at the end of the refining process.

Both chemical refining and physical refining start with the degumming of the crude triglyceride oil.

The most commonly used degumming processes in the industry are water degumming, acid degumming, caustic refining and enzymatic degumming. The degumming step is responsible for most of the oil loss that occurs during the refining of vegetable oils.

The prime aim of the degumming process is to remove phospholipids. Phospholipids (or phosphatides) are a class of lipids that contain a glycerol group that is esterified with phosphoric acid and two fatty acids. The phosphate group can carry an organic residue such as choline (phosphatidylcholine), ethanolamine (phosphatidylethanolamine) or inositol (phosphatidylinositol).

Degumming exploits the affinity of phospholipids for water by converting them to hydrated gums. The hydrated gums are insoluble in oil and can be removed by centrifugation. The rate of hydration varies substantially for the different phospholipids. Phosphatidic acid and the salts of phosphatidic acid are commonly known as "Non Hydratable Phospholipids" or NHPs.

The phospholipid content of triglyceride oils is commonly measured as "phosphorous content" in parts per million. Soybean oil typically has a phosphorous content of 400-1200 ppm. Canola oil and sunflower oil typically have phosphorous contents of 200-900 ppm and 300-700 ppm, respectively.

The use of enzymes for the removal of gums from crude vegetable oils is fairly recent. The first industrial enzymatic degumming process was launched in 1992. Examples of enzymes that have been used in enzymatic degumming of crude triglyceride oils include:

phospholipase A1 (e.g. Quara® LowP and Lecitase® Ultra, ex Novozymes)

phospholipase A2 (e.g. Rohalase PL-Xtra® and Rohalase MPL®, ex AB Enzymes. LysoMax®, ex Danisco)

phospholipase C (e.g Purifine®, ex DSM)

lipid acyltransferase (LysoMax®, ex Danisco)

Phospholipase A1, phospholipase A2 and lipid acyltransferase catalyse the removal of a fatty acid from phospholipids and thereby cause a lysophospholipid to be formed. This lysophospholipid is more hydrophilic than its non-hydrolysed precursor and can be removed more easily from the triglyceride oil.

Phospholipase C catalyses the hydrolysis of phospholipids such as phosphatidylcholine and phosphatidylethanolamine, forming diacylglycerol and a water-soluble phosphate-bearing ester fragment. The diacylglycerols produced remain in the oil and provide a bonus oil yield that is retained throughout the refining process.

U.S. Pat. No. 8,956,853 describes a method for degumming an oil composition, the method comprising (a) providing an oil composition containing a quantity of phospholipids, (b) contacting said oil composition simultaneously with one or more phospholipase A enzymes and one or more phospholipase C enzymes, and (c) separating the phospholipids reaction products from the oil composition.

EP-A 2 053 118 describes a method for removing phosphatide from crude oil obtained from a plant or animal source, the method comprising:

providing crude oil containing nonhydratable phosphatide, treating the crude oil with immobilized phospholipase, free of emulsification, to effect conversion of the non-hydratable phosphatide to hydratable phosphatide, mixing the treated crude oil with pure water or an aqueous solution, free of emulsification, to form a mixture having an oil phase and an aqueous phase, allowing separation of the oil phase and the aqueous phase, and collecting the oil phase.

US 2004/0005399 describes a process for the pretreatment of a vegetable oil selected from the group consisting of rice bran oil, soybean oil, sunflower oil and palm oil prior to physical refining of said vegetable oil, said process comprising subjecting the vegetable oil to enzymatic degumming using a phospholipase $A_1$ enzyme solution, separating the gums, and bleaching the degummed vegetable oil so obtained to obtain a degummed vegetable oil amenable to physical refining.

SUMMARY OF THE INVENTION

The inventors have developed an enzymatic degumming process that is extremely effective in removing phospholipids, including non-hydratable phospholipids (NHP), from unrefined vegetable oils and that produces degummed vegetable oil in high yield. More particularly, the inventors have found that effectiveness of enzymatic degumming processes can be improved significantly if the enzymolysis of the phospholipids is carried out at a pH in the range of 2.5 to 4.5 using phospholipase A1 and/or phospholipase A2, and if said enzymolysis is followed by the addition of base prior to separation of the degummed triglyceride oil from the emulsion.

Thus, the invention relates to a process for enzymatic degumming of unrefined triglyceride oil, said process comprising the following successive steps:

a) providing an unrefined triglyceride oil having a phosphorus content of at least 100 mg per kg of unrefined triglyceride oil;
b) combining the unrefined triglyceride oil with water, an acid and a phospholipase to produce an oil-in-water emulsion having a pH in the range of 2.5 to 4.5; said phospholipase being selected phospholipase A1, phospholipase A2 and combinations thereof;
c) keeping the emulsion at a temperature of 20-90° C. for at least 10 minutes;
d) introducing a base into the emulsion; and
e) separating degummed triglyceride oil from the emulsion.

Although the inventors do not wish to be bound by theory, it is believed that maximum conversion of non-hydratable phospholipids to lyso-phospholipids can be achieved using phospholipase A1 and/or A2 at pH 2.5 to 4.5. The emulsion so obtained, however, tends to be very stable, resulting in less efficient separation of the degummed triglyceride oil. The addition of caustic prior to separation was found to substantially improve separation efficiency as demonstrated by reduced levels of P, Ca and/or Mg.

The invention also relates to a degummed triglyceride oil that is obtained by the present process.

DETAILED DESCRIPTION OF THE INVENTION

Accordingly, a first aspect of the invention relates to a process for enzymatic degumming of unrefined triglyceride oil, said process comprising the following successive steps:

a) providing an unrefined triglyceride oil having a phosphorus content of at least 100 mg per kg of unrefined triglyceride oil;
b) combining the unrefined triglyceride oil with water, an acid and a phospholipase to produce an oil-in-water emulsion having a pH in the range of 2.5 to 4.5; said phospholipase being selected phospholipase A1, phospholipase A2 and combinations thereof;
c) keeping the emulsion at a temperature of 20-90° C. for at least 10 minutes;
d) introducing a base into the emulsion; and
e) separating degummed triglyceride oil from the emulsion.

The term "oil" as used herein refers to a lipid material that can be liquid, solid or semi-solid at ambient temperature (20° C.). The terms "oil" and "fat" are used interchangeably.

The term "triglyceride oil" as used herein refers to an oil containing at least 75 wt. % triglycerides.

The term "unrefined triglyceride oil" as used herein refers to a triglyceride oil that has a phosphorus content of at least 100 mg per kg. Crude triglycerides oils that have been extracted from a natural source are an example of unrefined triglyceride oils. Another example of unrefined triglyceride oils are partially degummed triglyceride oils. Partially degummed triglyceride oils may be produced by water-degumming of crude triglyceride oils.

The "phosphorus content" as referred to herein is measured by:

ISO 10540-3:2002 (Animal and vegetable fats and oils—Determination of phosphorus content—Part 3: Method using inductively coupled plasma (ICP) optical emission spectroscopy 90.93 ISO/TC 34/SC 11)

The term "phospholipase" as used herein refers to enzyme that hydrolyze phospholipids into fatty acids and other lipophilic substances. There are four major classes, termed A, B, C and D, distinguished by the type of reaction which they catalyze:

Phospholipase A
- Phospholipase A1—cleaves the SN-1 acyl chain
- Phospholipase A2—cleaves the SN-2 acyl chain Phospholipase B—cleaves both SN-1 and SN-2 acyl chains Phospholipase C—cleaves before the phosphate, releasing diacylglycerol and a phosphate-containing head group.

Phospholipase D—cleaves after the phosphate, releasing phosphatidic acid and an alcohol.

The term "acid" as used herein refers to a Brønsted-Lowry acid, i.e. a substance that is a proton (hydrogen ion) donor.

The term "citric acid" as used herein, unless indicated otherwise, refers to citric acid (2-hydroxypropane-1,2,3-tricarboxylic acid) as well as alkali metal salts of citric acid.

The term "phosphoric acid" as used herein, unless indicated otherwise, refers to phosphoric acid ($H_3PO_4$) as well as alkali metal salts of phosphoric acid.

The term "lactic acid" as used herein, unless indicated otherwise, refers to lactic acid (2-Hydroxypropanoic acid) as well as alkali metal salts of lactic acid.

The term "base" as used herein refers to a Brønsted-Lowry base, i.e. a substance that is a proton (hydrogen ion) acceptor.

The unrefined triglyceride oil that is degummed in the present process preferably has a phosphorus content of at least 150 mg per kg of unrefined triglyceride oil, more preferably of at least 200 mg per kg of unrefined triglyceride oil and most preferably of at least 300 mg per kg of unrefined triglyceride oil. Typically, the phosphorus content of the unrefined triglyceride oil does not exceed 2,000 mg per kg of unrefined triglyceride oil.

The calcium content of the unrefined triglyceride oil preferably is at least 10 mg per kg unrefined triglyceride oil, more preferably at least 30 mg per kg of unrefined triglyceride oil. Typically, the unrefined triglyceride oil contains not more than 200 mg, preferably not more than 150 mg calcium per kg of unrefined triglyceride oil.

The magnesium content of the unrefined triglyceride oil preferably is at least 10 mg per kg of unrefined triglyceride oil, more preferably at least 30 mg per kg of unrefined triglyceride oil. Typically, the unrefined triglyceride oil contains not more than 200 mg, more preferably not more than 150 mg magnesium per kg of unrefined triglyceride oil.

Besides triglycerides and phospholipids, the unrefined triglyceride oil typically contains other lipid component such as diglycerides, monoglycerides, free fatty acids, tocopherols, tocotrienols etc. The unrefined triglyceride oil preferably contains at least 80 wt. %, more preferably at least 85 wt. % triglycerides.

The unrefined triglyceride oil that is degummed in the present process preferably is an unrefined vegetable oil.

Examples of unrefined vegetable oils that can suitably be degummed by the present process include unrefined soybean oil, unrefined rapeseed oil, unrefined sunflower oil, unrefined corn oil, unrefined cottonseed oil, unrefined palm oil, unrefined rice bran oil, unrefined arachis oil and combinations thereof. More preferably, the unrefined vegetable oil is selected from unrefined soybean oil, unrefined rapeseed oil, unrefined sunflower oil, unrefined corn oil, unrefined cottonseed oil, unrefined arachis oil and combinations thereof.

The unrefined triglyceride oil that is used in the present process is preferably produced by solvent extraction, more preferably by extracting crushed seed or crushed fruit with n-hexane.

In step b) of the present process the unrefined triglyceride oil may be combined with water, acid and enzyme in successive stages. For instance, water may be introduced during a water degumming step which is followed by other process steps in which acid and enzyme (and little or no water) are added.

In step b) water is preferably combined with the unrefined triglyceride oil in a total amount of 5-100 ml water per kg or unrefined triglyceride oil, more preferably of 10-70 ml water per kg or unrefined triglyceride oil and most preferably of 15-60 ml water per kg or unrefined triglyceride oil. The total amount of water that is introduced in step b) includes water that is introduced together with lactic acid and/or the enzyme.

The acid that is applied in step b) is preferably selected from citric acid, phosphoric acid, lactic acid and combinations thereof.

In accordance with a preferred embodiment of the present process, acid is combined with the unrefined triglyceride oil in a total amount of 100-3,000 mg per kg of unrefined triglyceride oil, more preferably in a total amount of 200-2,000 mg per kg of unrefined triglyceride oil and most preferably in a total amount of 350-1,500 mg per kg of unrefined triglyceride oil.

According to a preferred embodiment, the step b) acid is introduced in the form of the protonated acid, i.e. not as a salt. Accordingly, in a preferred embodiment, step b) comprises combining protonated acid with the unrefined triglyceride oil in a total amount of at least 100 mg per kg of unrefined triglyceride oil, more preferably in a total amount of at least 200 mg per kg of unrefined triglyceride oil and most preferably in a total amount of at least 350 mg per kg of unrefined triglyceride oil.

The enzyme employed in step b) of the present process preferably is selected from the group of phospholipase A1, phospholipase A2 and combinations thereof. Most preferably, the phospholipase is phospholipase A1. Quara® LowP is an example of a commercially available phospholipase A1 that can advantageously be employed in the present process.

According to a particularly preferred embodiment, the enzyme employed in the present process has maximum activity at a pH in the range of 2.5-4.0. Examples of phospholipase that have maximum activity within this acid pH range are Quara® LowP and Rohalase PL-Xtra®.

In the present process, the enzyme is typically combined with the unrefined triglyceride oil in the form of an enzyme product that contains pure enzyme and carrier material. Typically, this enzyme product is combined with the unrefined triglyceride oil in a dose of 10-300 mg enzyme per kg of oil. More preferably, the enzyme product is applied in a dose of 20-200 mg enzyme per kg of oil and most preferably in a dose of 30-150 mg enzyme per kg of oil.

The water-and-oil emulsion that is produced in step b) of the present process preferably is water-in-oil emulsion. Even more preferably, the emulsion is a water-in-oil emulsion comprising a dispersed aqueous phase having volume weighted mean diameter of less than 100 microns, more preferably of 5-30 microns. The volume weighted mean diameter of the dispersed phase can suitably be determined by means of laser diffraction.

The production of the water-and-oil emulsion in step b) preferably comprises emulsification in a mixer, preferably a medium or high shear mixer.

The water-and-oil emulsion that is produced in step b) typically contains 0.5-10 wt. %, more preferably 1-7 wt. % and most preferably 1.5-6 wt. % water.

The aqueous phase of the water-and-oil emulsion preferably has a pH in the range of 2 to 6, more preferably of 2.5 to 5.0 and most preferably of 3.0 to 4.5.

In a particularly preferred embodiment of the present invention the unrefined triglyceride oil is combined with the acid some time before addition of the enzyme. By allowing the acid to interact with the non-hydratable phospholipids in the unrefined triglyceride oil these phospholipids are rendered more susceptible for enzymatic hydrolysis. Accordingly, in a particularly preferred embodiment, step b) of the present process comprises the successive steps of:

b1) mixing the unrefined triglyceride oil with an aqueous acid solution;

b2) keeping the mixture at a temperature of 20-90° C. for at least 5 minutes; and b3) combining the mixture with an aqueous solution of the enzyme to prepare the oil-and-water emulsion.

The acid solution that is mixed with the triglyceride oil in step b1) preferably contains 5-92 wt. %, more preferably 10-90 wt. % and most preferably 35-88 wt. % acid. The acid solution might suitably be buffered. An examples of such a buffered acid solution is a solution comprising a combination of citric acid and sodium hydroxide.

Step b2) preferably comprises keeping the mixture at a temperature of 35-95° C. for at least 5 minutes, more preferably at a temperature of 45-90° C. for at least 5 minutes, most preferably at a temperature of 45-85° C. for at least 10 minutes. Preferably, the mixture is stirred while being kept at elevated temperature in step b2).

Step c) of the degumming process of the present invention preferably comprises keeping the emulsion at temperature of 35-85° C. for at least 10 minutes, preferably for at least 15 minutes. More preferably, step c) comprises keeping the emulsion at temperature of 40-80° C. for at least 10 minutes, more preferably for at least 15 minutes and most preferably for 30-360 minutes. Preferably, the emulsion is stirred while being kept at elevated temperature in step c).

Step d) of the present process comprises the introduction of a base into the emulsion. The base that is introduced into the emulsion is preferably selected from sodium hydroxide, potassium hydroxide, sodium bicarbonate, potassium bicarbonate, sodium carbonate, potassium carbonate, sodium silicate and combinations thereof. More preferably, the base is selected from sodium hydroxide, sodium carbonate and combinations thereof.

The base is preferably introduced into the emulsion in step d) to increase the pH of the emulsion with at least 0.2 pH points, more preferably with at least 0.4 pH points and most preferably with 0.6 to 1.5 pH points.

Typically, the base is introduced in step d) to increase the pH to more than 4.3, more preferably to increase the pH to 4.4-5.5, most preferably to increase the pH to 4.5-5.0.

According to another preferred embodiment, the base is introduced into the emulsion in the form of an aqueous solution. This aqueous solution preferably contains 0.05 to 12 mol/L of base, more preferably 0.1 to 5 mol/L of base and most preferably 0.5 to 2 mol/L of base.

In the present process the degummed oil is separated from the emulsion in step e). This separation typically comprises separation of the oil phase and the aqueous phase of the emulsion. The aqueous phase contains phospholipids and hydratable phospholipid breakdown products that were produced in step c) by removing the aqueous phase a degummed oil is obtained having a reduced phospholipid content.

The degummed triglyceride oil can be separated from the emulsion using separation techniques known in the art, such as centrifugation, decantation etc. Preferably, the degummed triglyceride oil is separated from the emulsion by means of centrifugation.

Typically, the phosphorus content of the degummed triglyceride oil (in mg per kg) that is obtained in the present process is less than 30%, more preferably less than 20% of the phosphorus content of the unrefined triglyceride oil (in mg per kg).

The calcium content of the degummed triglyceride oil (in mg per kg) is typically less than 40%, more preferably less than 30% of the calcium content of the unrefined triglyceride oil (in mg per kg).

The magnesium content of the degummed triglyceride oil (in mg per kg) is typically less than 40%, more preferably less than 30% of the magnesium content of the unrefined triglyceride oil (in mg per kg).

The degummed triglyceride oil that is obtained by the present process preferably has a phosphorus content of less than 150 mg per kg of degummed triglyceride oil. More preferably, the degummed triglyceride oil has a phosphorus content of less than 100 mg per kg of degummed triglyceride oil, even more preferably of less than 50 mg per kg of degummed triglyceride oil. Most preferably, the degummed triglyceride oil has a phosphorus content of less than 20 mg per kg of degummed triglyceride oil.

The degummed triglyceride oil that is obtained by the present process preferably has a calcium content of less than 50 mg per kg of degummed triglyceride oil. More preferably, the degummed triglyceride oil has a calcium content of less than 20 mg per kg of degummed triglyceride oil, even more preferably of less than 10 mg per kg of degummed triglyceride oil. Most preferably, the degummed triglyceride oil has a calcium content of less than 5 mg per kg of degummed triglyceride oil.

The degummed triglyceride oil that is obtained by the present process preferably has a magnesium content of less than 50 mg per kg of degummed triglyceride oil. More preferably, the degummed triglyceride oil has a magnesium content of less than 15 mg per kg of degummed triglyceride oil, even more preferably of less than 7 mg per kg of degummed triglyceride oil. Most preferably, the degummed triglyceride oil has a magnesium content of less than 3 mg per kg of degummed triglyceride oil.

The degummed triglyceride oil that is obtained in the present process may suitably be further processed to produce a refined triglyceride oil. Examples of further processing steps that may be employed include neutralization, bleaching and deodorization. Preferably, the degummed oil is further processed to produce a refined triglyceride oil, said further processing comprising deodorization of the triglyceride oil. Most preferably the further processing comprises bleaching of the degummed triglyceride oil followed by deodorization of the bleached triglyceride oil.

The refined triglyceride oil that is obtained by a process that comprises the aforementioned additional processing preferably has a free fatty acid content of less than 0.25%, more preferably of less than 0.05%.

Another aspect of the invention relates to a triglyceride oil that is obtained by a process as defined herein.

The invention is further illustrated by the following non-limiting examples.

EXAMPLES

Example 1

Crude soybean oils were degummed using phosphoric acid in combination with phospholipase (Quara® LowP, ex Novozymes). The following degumming procedure was used:

- 100 grams of crude soybean oil was homogenized and heated to 70° C.;
- phosphoric acid was added in the form of a 85% (w/w) aqueous solution in an amount equivalent to 900 mg (dry) phosphoric acid per kg of oil;
- the combination of crude oil and aqueous acid solution was mixed in high shear mixer for 15 seconds to produce an emulsion;
- the emulsion was kept at 70° C. for 40 minutes under stirring;
- next, a solution containing 3 grams of water and 5 mg of Quara® LowP was added to the hot oil;
- the mixture was submitted to high shear mixing for 60 seconds in order to generate proper emulsion/dispersion of water in oil, and kept for 210 min under constant stirring and constant temperature of 70° C.

Next, prior to centrifugal separation, the emulsion was processed in three different ways:

- No addition of base (pH of emulsion was 4.2)
- Addition of 100 mg base (sodium carbonate) per kg of oil (pH of emulsion was 4.8)
- Addition of 200 mg base (sodium carbonate) per kg of oil (pH of emulsion was 5.1)

Base was added to the emulsion by mixing the emulsion with 0.3 g of an aqueous solution of sodium carbonate (33 or 66 mg/mL) using a magnetic stirrer. The emulsion was kept at 90° C. for 2 minutes. Next, the aqueous phase was separated from the degummed oil phase by centrifugation. The oil yields achieved by the three different enzymolysis procedures were very similar.

Before and after degumming the soybean oil was analysed to determine phosphor content and the concentration of calcium, magnesium. The results are shown in Table 1.

TABLE 1

| | P (mg/kg) | Ca (mg/kg) | Mg (mg/kg) |
|---|---|---|---|
| Crude oil | 1,080 | 140 | 95 |
| No base added after enzymolysis | 51 | 4.4 | 4.5 |
| 100 ppm base added after enzymolysis | 19 | 1.7 | 1.7 |
| 200 ppm base added after enzymolysis | 16 | 2.4 | 1.6 |

Example 2

Example 1 was repeated, except that this time, instead of 900 mg phosphoric acid per kg of oil, 800 mg lactic acid was added per kg of crude soybean oil in the form of a 85% (w/w) aqueous solution.

The emulsion that had been prepared without addition of base had a pH of 4.1. The emulsion to which 100 ppm sodium carbonate had been added, had a pH of 5.1. The emulsion to which 200 ppm sodium carbonate had been added, had a pH of 5.4.

Again, The oil yields achieved by the three different enzymolysis procedures were very similar The results from the analysis are summarized in Table 2.

TABLE 2

| | P (mg/kg) | Ca (mg/kg) | Mg (mg/kg) |
|---|---|---|---|
| Crude oil | 1,080 | 140 | 95 |
| No base added after enzymolysis | 66 | 7.5 | 8.1 |
| 100 ppm base added after enzymolysis | 23 | 4.7 | 3.0 |
| 200 ppm base added after enzymolysis | 11 | 1.6 | 1.2 |

The invention claimed is:

1. A process for enzymatic degumming of unrefined triglyceride oil, said process comprising the following successive steps:

a) providing an unrefined triglyceride oil having a phosphorus content of at least 100 mg per kg of unrefined triglyceride oil;

b) combining the unrefined triglyceride oil with water, an acid and a phospholipase to produce an oil-and-water emulsion having a pH in the range of 2.5 to 4.5; said phospholipase being selected phospholipase A1, phospholipase A2 and combinations thereof;

c) keeping the emulsion at a temperature of 20-90° C. for at least 10 minutes;

d) introducing a base into the emulsion; and e) separating degummed triglyceride oil from the emulsion.

2. Process according to claim 1, wherein the acid is selected from citric acid, phosphoric acid, lactic acid and combinations thereof.

3. Process according to claim 1, wherein the base is selected from sodium hydroxide, potassium hydroxide, sodium bicarbonate, sodium carbonate, sodium silicate and combinations thereof.

4. Process according to claim 1, wherein the base is introduced to increase the pH of the emulsion with at least 0.4 pH points.

5. Process according to claim 1, wherein the base is introduced to increase the pH to more than 4.3.

6. Process according to claim 1, wherein the base is introduced to increase the pH to not more than 5.5.

7. Process according to claim 1, wherein the phospholipase is phospholipase A1.

8. Process according to claim 1, wherein the phospholipase has maximum activity at a pH in the range of 2.5-4.0.

9. Process according to claim 1, wherein water is combined with the unrefined triglyceride oil in a total amount of 5-100 ml water per kg or unrefined triglyceride oil.

10. Process according to claim 1, wherein step b) of the process comprises the successive steps of:

b1) mixing the unrefined triglyceride oil with an aqueous acid solution;

b2) keeping the mixture at a temperature of 20-90° C. for at least 5 minutes; and b3) combining the mixture with an aqueous solution of the enzyme to prepare the oil-and-water emulsion.

11. Process according to claim 1, wherein step c) of the process comprises keeping the emulsion at temperature of 35-85° C. for at least 10 minutes.

12. Process according to claim 1, wherein the degummed triglyceride oil is separated from the emulsion by means of centrifugation.

13. Process according to claim 1, wherein the emulsion has a temperature of 50-100° C. when the degummed triglyceride oil is separated therefrom.

14. Process according to claim 1, wherein the degummed triglyceride oil has a phosphorus content of less than 150 mg per kg of unrefined degummed triglyceride oil.

* * * * *